US005411072A

United States Patent [19]

Starck et al.

[11] Patent Number: 5,411,072

[45] Date of Patent: May 2, 1995

[54] FOLDABLE PARTITION

[75] Inventors: Hans Starck, Munich, Germany; Guy E. Dixon, III, Coral Gables, Fla.

[73] Assignee: Panelfold, Inc., Miami, Fla.

[21] Appl. No.: 214,669

[22] PCT Filed: Jan. 10, 1991

[86] PCT No.: PCT/US91/00033

§ 371 Date: Jul. 16, 1992

§ 102(e) Date: Jul. 16, 1992

[87] PCT Pub. No.: WO91/10802

PCT Pub. Date: Jul. 25, 1991

Related U.S. Application Data

[63] Continuation of Ser. No. 910,146, Jul. 16, 1992, abandoned.

[30] Foreign Application Priority Data

Jan. 10, 1990 [DE] Germany ..... 900231 U
May 11, 1990 [DE] Germany ..... 9005382 U

[51] Int. Cl.[6] ..... E06B 3/94
[52] U.S. Cl. ..... 160/84.11
[58] Field of Search ..... 160/84.1 G, 84.2, 84.3, 160/199, 206

[56] References Cited

U.S. PATENT DOCUMENTS

| | | | |
|---|---|---|---|
| 3,481,388 | 12/1969 | Smart | 160/231 |
| 3,672,424 | 6/1972 | Brown | 160/40 |
| 3,799,237 | 3/1974 | Proserpi | 160/199 |
| 3,979,861 | 9/1976 | Fromme et al. | 52/71 |
| 4,199,018 | 4/1980 | Hirschel et al. | 160/84 |
| 4,598,751 | 7/1986 | Peeters-Weem | 160/84 |
| 4,658,878 | 4/1987 | Williams | 160/84 |
| 4,763,712 | 8/1988 | van der Klaauw | 160/84.1 |
| 4,848,436 | 7/1989 | Dagenais | 160/199 |
| 4,867,221 | 9/1989 | Dixon et al. | 160/84 |
| 4,953,611 | 9/1990 | Verstraten | 160/199 |

*Primary Examiner*—David M. Purol
*Attorney, Agent, or Firm*—Jacobson, Price, Holman & Stern

[57] ABSTRACT

The present invention provides a folding partition of the kind described, namely, one consisting of mutually opposite carrying bars, which are arranged in pairs and at their upper end portions are provided with brackets, which are displacable in tracks fixed to the ceiling, have panel elements interposed between the carrying bars, which are hinged on one side to adjacent carrying bars and are hinged together on their other sides. An arrangement is provided for pivotally moving the panel elements such that as they are pushed together from a closed position in which they lie flat substantially in a plane, the panels fold up into an open stacked position.

48 Claims, 10 Drawing Sheets

FOLDABLE PARTITION

This is a continuation of application Ser. No. 07/910,146, filed Jul. 16, 1992, now abandoned.

FIELD OF INVENTION

This invention relates to a novel foldable partition which when extended lies flat substantially in a common plane, or in a shallow corrugation.

BACKGROUND

Flat folding doors or walls are basically known from the following publications: Published German application 28 39 099; German Patent Specification 28 45 033; Published German Application 25 06 349; German Patent Specification 29 12 514; Published European Patent Application 0 111 9652; U.S. Pat. No. 4,199,018; German Patent Publication 24 38 985; Published Patent Application 00 76 879; Published German Application 29 35 305; Published German Application 25 59 443; German Patent Specification 16 83 191; German Patent Specification 11 57 757; German Utility Model 69 11 040; German Utility Model 78 27 705; Published European Patent Application 0 305 801.

In these known folding doors or walls, hinges are provided between carrying bars and panel elements. The hinges interconnect the panel elements but render the assembling of the doors or walls difficult and complicated and also complicate access to the folding door or wall for servicing or repairs.

SUMMARY OF THE INVENTION

The term "partition" in the present specification means door, wall partition and the like. The present invention provides a folding partition of the kind described, namely, one consisting of mutually opposite carrying bars, which are arranged in pairs and at their upper end portions are provided with brackets, which are displacable in tracks fixed to the ceiling, have panel elements interposed between the carrying bars, which are hinged on one side to adjacent carrying bars and are hinged together on their other sides. Means are provided for pivotally moving the panel elements such that as they are pushed together from a closed position in which they lie flat substantially in a plane, the panels fold up into an open stacked position.

It is, thus, the principal object of this invention to provide a novel structure for a folding partition which can be assembled, serviced and repaired in a much simpler and more expeditious manner than heretofore possible.

Other objects and advantages of the present invention will become more readily apparent from the following detailed description of preferred embodiments when taken in conjunction with the appended drawings in which like parts have been designated by the same reference numerals.

DESCRIPTION OF PREFERRED EMBODIMENTS

Figure 2:
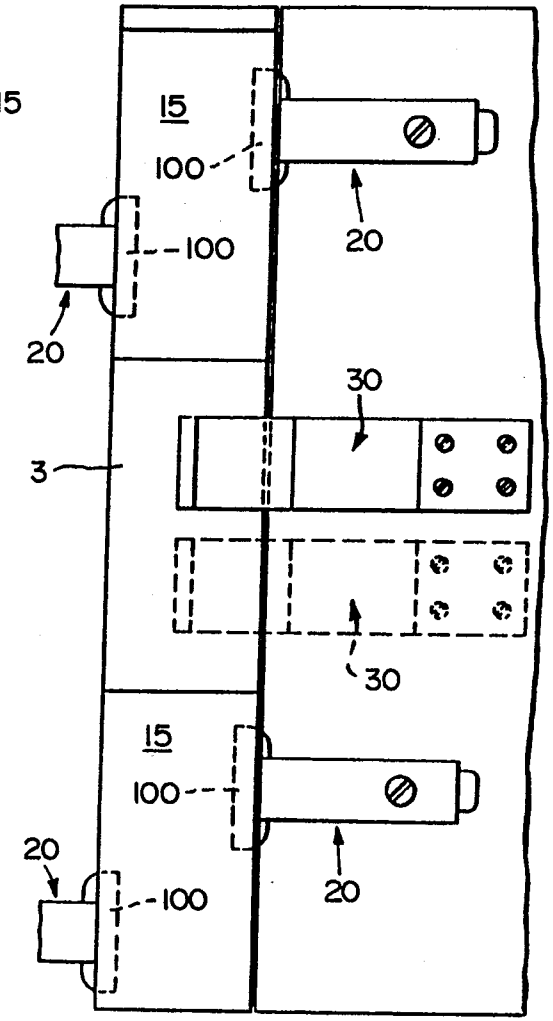
FIG. 2 is an enlarged view showing a portion of FIG. 1 to illustrate a hinge between a panel element and a carrying bar.

Referring now to the drawings, a detailed description of a preferred embodiment follows.

Folding partition 1 shown in the drawings consists of pairs of hingedly interconnected panel elements, 2, 2'. A pair of hinges 4 interconnect the adjacent, juxtaposed edges of rigid panel elements 2 and 2'. The pair of hinges 4 are preferably of the loose pin type and secured to the inside of panels 2, 2' with one hinge plate 5 secured to panel 2' and the other plate 6 secured to panel 2. The plates 5 and 6 have intermeshing eyelets 8 and 9 that receive a loose, headed pin 12. The panel elements 2, 2' on their remote free edges are hingedly connected to adjacent carrying bars or posts 3. The pairs of panel elements 2, 2' and the intermediate carrying bars or posts 3 constitute one side of the partition which may be a wall or a door. Like panel elements 2, 2' and associated carrying bars or posts 3 constitute the other side of the folding partition 1 as will be apparent from FIG. 3.

Figure 1:
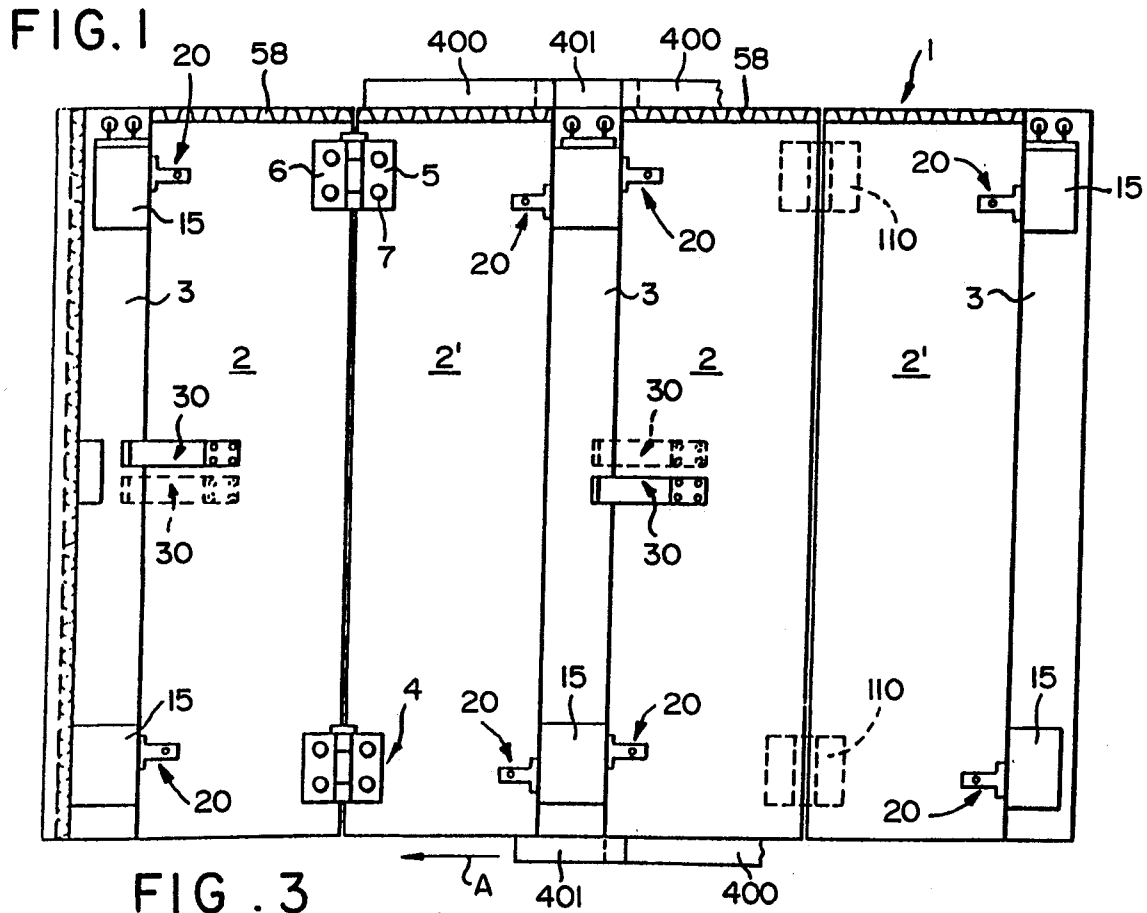
FIG. 1 is a view in elevation showing the inside surface of one side of a dual-walled partition shown in a closed, flat state.
Figure 3:
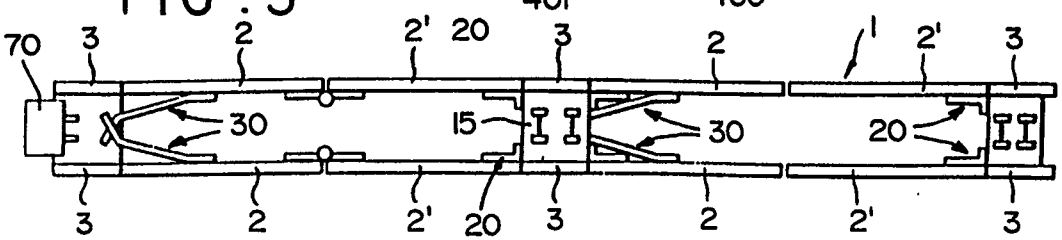
FIG. 3 is a top plan view showing both sides of the closed dual-walled partition shown in FIG. 1.

In accordance with FIGS. 1 and 3, the pairs of panel elements 2, 2' are interconnected by so-called curled-up hinges 4 having platelike hinge parts 5, 6, which are connected by fixing screws 7 to the inside surfaces of respective panel elements 2, 2' in the manner described such that the vertically spaced apart curled-up eyes are meshing and disposed in the gap between the panel elements 2, 2'. The hinge pin 12 is provided at its top with a head 11 and extends with a clearance through the aligned bores of the curled-up eyes 8, 9, so that pin 12 can be readily removed. To this end, top hinge 4 is spaced sufficiently below the top edge of panels 2, 2' that pin 12 can be lifted vertically and removed from eyelets 8,9.

Mutually opposite carrying bars or posts 3 are mounted on or interconnected by an approximately rectangular block or cleat 15. The width of the blocks 15 approximately corresponds to the width of the carrying bars 3 so that the narrow end faces 16, 17 of the carrying bars 3 lie in a common plane with the outside surfaces 18, 19 of the block 15, see FIG. 4. For hingedly connecting the panel elements 2, 2' to the carrying bars 3, mutually opposite outer end faces of the carrying bars 3 and of the cleats 15 are provided with milled recesses 100, in which pivotally movable cup-shaped hinge parts 20' of double-link hinges 20 are held in the usual manner, e.g., the countersinkable cups 20' are provided with flangelike parts 21, which protrude over the rims of the milled recesses and are formed with bores through which fixing screws 21' fasten hinges to block 15 and posts 3. The hinge arm or bracket 22 and its mounting plate 23, fixed by screws to panel element 2 or 2' are connected by two links to the cup shaped hinge parts 20'. The double-link hinges 20 preferred in the present invention are of the kind made and sold by Salice America, Inc., of Charlotte, N.C., especially the Salice 100, 200 or F, models C1A6, C2A7, C2A6, C2A9 and CFA7 equipped with DOMI® rapid assembly mounting plates. Use of the DOMI® automatic assembly enables the hinge to be attached and detached from the mounting plate with only slight pressure thereby facilitating quick attachments and detachment for assembly or repair. Other like hinges are commercially available, e.g.: from Juluis Blum Inc. of Stanley, N.C. under the trademark BLUM® "clip" concealed hinges.

Figure 4:
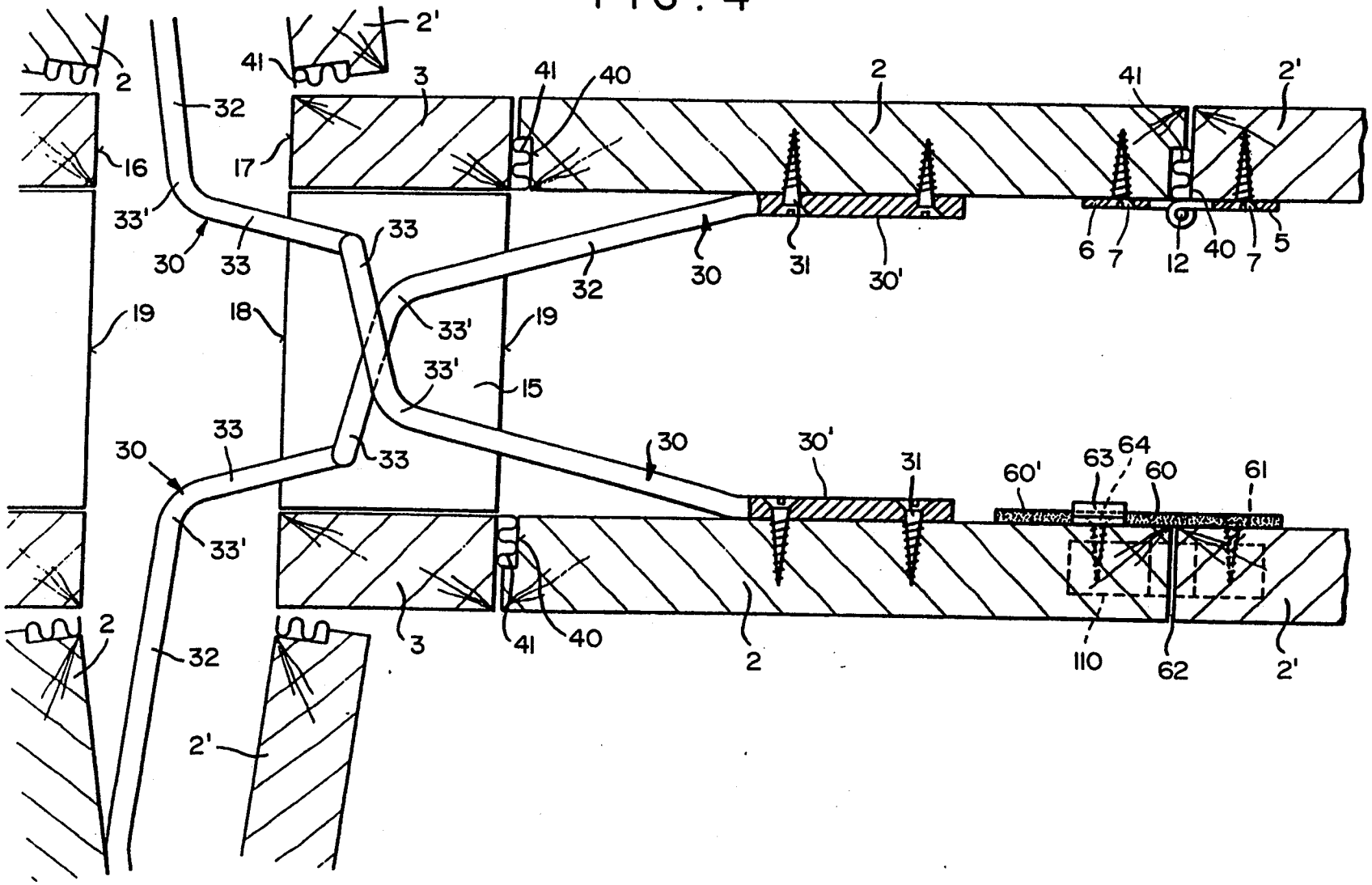
FIG. 4 is a horizontal sectional view showing in larger scale the folding partition of FIG. 3 as it is pushed to its open position at a time when two hingedly interconnected panel elements have already been moved to their folded or stacked position.

The hingedly interconnected pairs of panel elements 2, 2' of each side move in the direction A of the opening movement, see arrow in FIG. 1 when opening the partition to its stacked condition. Folding bracket or angles 30, also referred to as actuator arms, are secured to the inside of panels 2 about their midpoint. Angle or initiator arm 30 consists of a leg 30' which is connected by fixing screws 31 to the panel element 2 equidistant from its vertical edges and a leg 32, which extends approximately at about 30° and a leg 33, which is a continuation of leg 32. A bend 33 puts leg 33 at an angle to leg 30' of from 60° to preferably 90°. Leg 33 constitutes a deflector or pusher and during an opening movement will, through interaction with another element, exert a force on the associated panel element to which it is attached and which still lies in the closing plane to produce a buckling moment for initiating the desired folding action. FIG. 4 shows the position at which the legs 33 of those panel elements 2 which are still in their closed position strike against the legs 33 of the panel elements 2 which precede or lead them in the opening direction (see arrow A). Legs 33 of succeeding panels 2 strike the now stationary legs 33 of the next leading or preceding panels 2 which have already been turned through about 90°. As a result, a buckling moment for initiating the folding is exerted on the next trailing or succeeding panel elements 2, which are shown in FIG. 4 still in their closed position.

The pairs of panel elements 2, 2' of both sides are provided at their narrow end faces with longitudinally extending grooves or recesses 40, in which slightly projecting sealing bars 41 are held. Bars 41 consist of elastomeric and/or plastically deformable material and protrude beyond the plane of the edge face. In the closed position shown on the right in FIG. 4, sealing bars 41 bear with deformation on the opposite end face of a panel element or of a carrying bar so that a tight and also noise-insulating seal is effected.

Instead of so-called curled-up hinges 4, so-called Stabilo hinges, mortise concealed hinges, may be used to hingedly interconnect the panel elements 2, 2'. Stabilo hinges consist of hinge cups, which are countersunk into the narrow end faces of the panel elements and held in by countersink screws or a wedge and are interconnected by hinge arms extending into such cups. Such hinges 110 are indicated by broken lines on the right in FIGS. 1 and 4. These hinges are also detachable and attachable for effecting assembly and repair by removing the countersunk screws or loosening the wedges and withdrawing the hinge cups.

Figure 5:
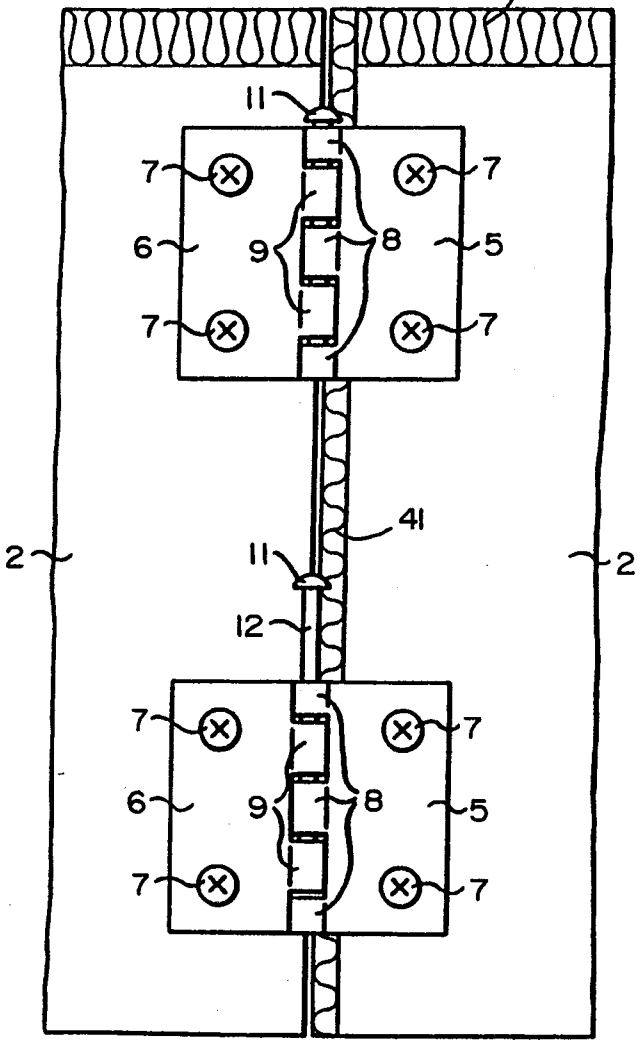
FIG. 5 is an enlarged fragmentary elevation showing a hinge between; the two panel elements of FIG. 1.
Figure 9:
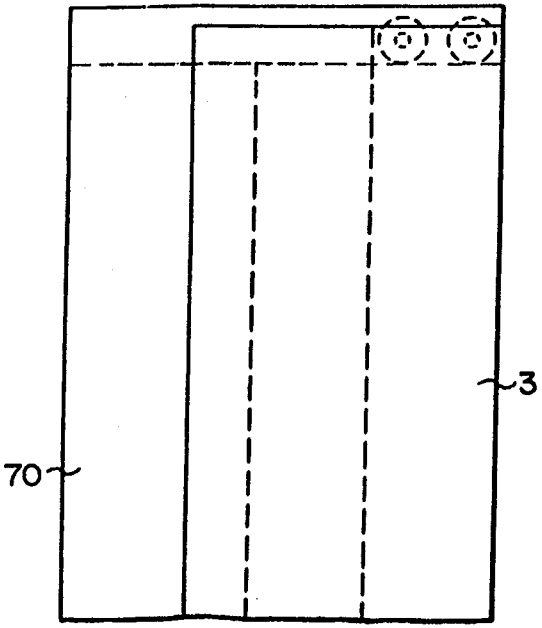
FIG. 9 is an elevation similar to FIG. 7 showing one end of the folding partition in a closed flat state.

The cleats 15 which interconnect pairs of opposed carrying bars 3 are provided at the top with a trolley carrying freely rotatable, axle mounted rollers 51 with the axle mounted on trolley-carrying shanks 50. The rollers 51 roll on a track 54, more specifically on flanges which form the rails of track 54 which are inwardly angled toward each other. The track 54 is secured to a base 112 such as by screws 114. Track 54 is covered on its outside surfaces by bars, boards or panels 55. The inside surfaces of the carrying bars 3 and the outside surfaces of the bars 55 define narrow gaps, which are bridged by strip-shaped seals 57 of any suitable acoustical or sound absorbing material. Seals 57 can be secured to the inside surfaces of the carrying bars 3 or outside surface of bars 55. Similarly, the inside surfaces of the panel elements 2, 2' are provided with sealing strips 58, see FIG. 5, also of a suitable acoustical or sound absorbing material, which in the closed state of the door are also in sealing contact with the covering bars 55. These sealing strips will also avoid an occurrence of striking sounds when the folding door is closed at a higher extension speed.

It is apparent from FIGS. 1 and 2 that the folding angles 30 of each side of the door are arranged in vertically spaced apart horizontal planes in such a manner that during an opening movement of the folding door each folding angle 30 will cooperate without conflict with the diagonally opposite folding angle 30. It is also apparent from FIGS. 1 and 2 that the double-link hinges 20 provided on the cleats 15 or on the end faces of the carrying bars 3 are vertically spaced apart in horizontal planes in such a manner that the hinges 20 will not strike against each other as the folding door is opened so that the door can be more compactly folded as it is opened.

It is apparent from FIG. 4 that an opening movement will impart to the panel elements 2, 2' such an outward pivotal movement that in a folded stacked state they will overlie and their narrow edges will lie adjacent to the outside surfaces of the carrying bars 3. The design also promotes close folding within a small space during the opening movement.

FIG. 4 shows in its bottom right-hand part a different embodiment of a seal in the gap between two panel elements. That seal consists of a strip 60, which is made from known sound-proofing sealing material, such as a flexible plastic, and extends throughout the height of the panel elements 2, 2'. Strip 60 at one of its edges is secured by screws 61 to the inside surface of the one panel element 2'. As is illustrated, the sealing strip 60 covers the small gap 62 between two panel elements 2, 2'. The juxtaposed opposite panel element 2 is provided on the inside surface of its edge portion with a flat receiving slot, which is defined by inverted U shaped channel members 63, which have been attached by screw 64. As the hinge 110 is established, the freely protruding portion of the sealing strip 60 is inserted into the slot that is formed by the channel member 63, so that the sealing strip 60 bridges and seals the gap 62, but the member 63 cooperates with strip 60 to allow sliding relative movement. Such a gap seal will be desirable when hinges 110 are used which comprise hinge cups which are countersunk in the end faces of the panel elements and would hinder use of sealing strip 41 in corresponding grooves or recesses 40. The freely protruding edge portions 60' of the sealing strips 60 are so long that they can be inserted into the slots before the hinge cups of the hinges 110 are inserted into the recesses and fixed by screws.

Figure 10:
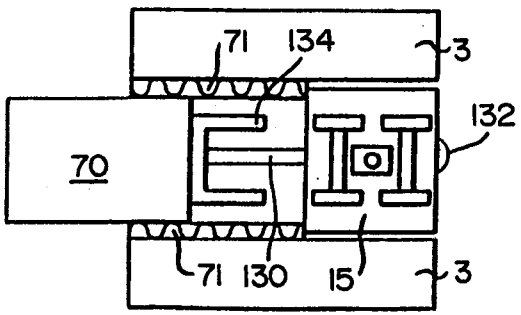
FIG. 10 is a top plan view of FIG. 9.
Figure 7:
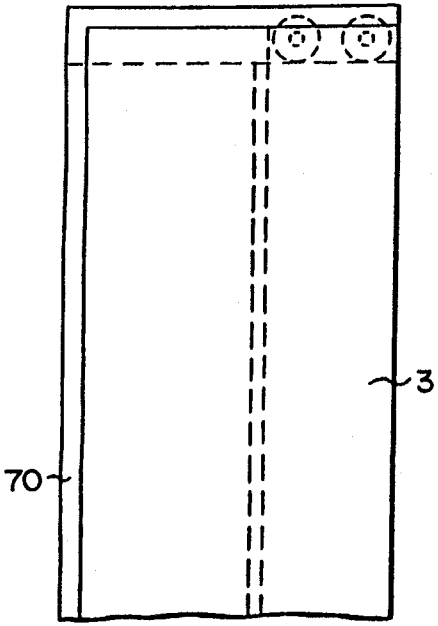
FIG. 7 is a side elevation at the fixed side showing one end of the folding partition in an open state.
Figure 8:
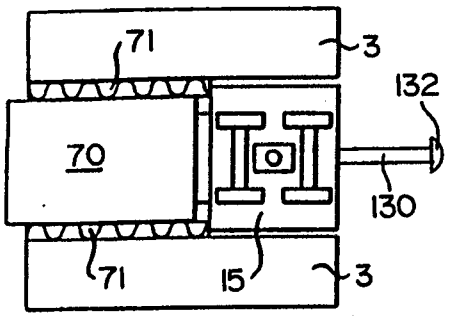
FIG. 8 is a top plan view of FIG. 7.
Figure 6:
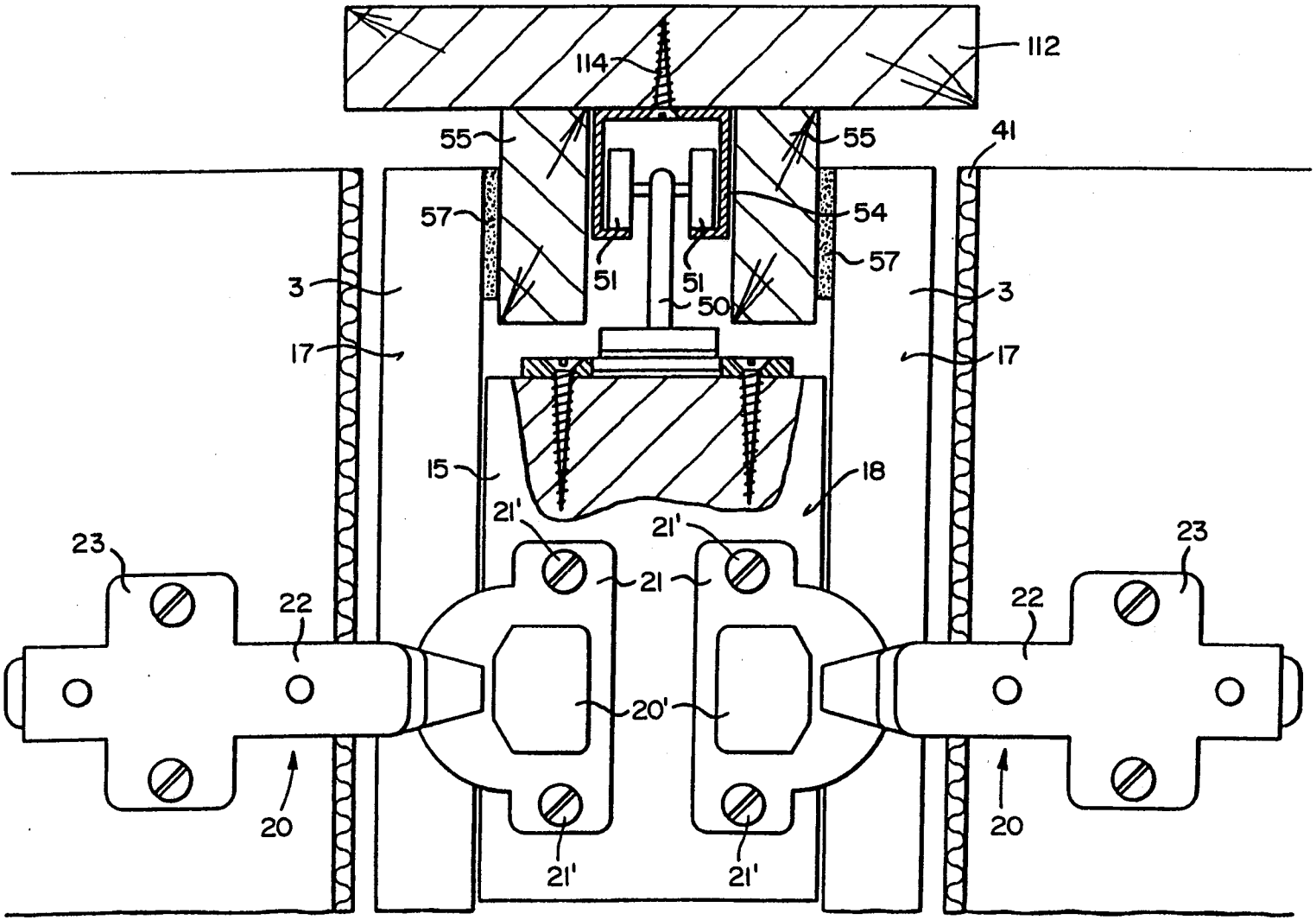
FIG. 6 is a vertical sectional view showing the hinge arrangement between two mutually opposite panel elements in an open or folded state.

FIGS. 8 and 10 show the stationary stop bars or jamb post 70, which is fixed on the wall or the door post in the direction of the opening movement of the partition and which during an opening movement of the partition is telescopically straddled by the leading or terminal carrying bars or posts 3, which are interconnected by the cleats 15. As is apparent from FIGS. 7 to 10 the terminal leading carrying bars 3 are extended beyond the cleats 15 toward the carrying wall to constitute forks, which can telescopically straddle the stop bar or jamb post 70 during the opening movement.

Layers or strips of known soundproofing material attached to the inside surfaces of the extended carrying bars will sealingly engage the planar outside surfaces of the stop bar 70. As the folding door is opened and closed, the sealing strips 71 wipe on the outside surfaces of the stop bar 70 so that a seamless sealing joint to the carrying bars is established.

A threaded closing stop 130 is fixed to the stop bar 70 and extends horizontally through a hole in lower cleat 15 terminating in a head 132 substantially larger than the hole. Stop 130 is threaded to allow adjustment. When the partition moves from the open position, FIG. 8, to the closed position, FIG. 10, stop 130 and head 132 limit travel of the first lower cleat 15, as shown. Also, starting upset brackets 134 are horizontally aligned to be struck by the first pair of angles 30 to initiate the opening sequence of the first pair of panels 2, 2'.

In a folding partition of the invention, the hinges between the panel elements 2, 2' consist of furniture hinges, in particular, loose pin hinges. The use of furniture hinges known per se affords the great advantage that the assembling is simple and access for repairs or servicing is simple and easy. For instance, when a panel element of the partition in accordance with the invention has been damaged and must be replaced, it will be sufficient to disconnect readily the hinges 4 between two panel elements when the partition is open or even partially open simply by removing pins 12. Hinges 4 are then accessible because the panel elements have been pivotally moved through about 180 degrees (90° each) relative to each other from their closed position and are now juxtaposed approximately parallel to each other but horizontally spaced apart. When the hinges 4 between two panel elements have been disconnected, these panel elements can freely be swung out. Hinges 20 connected to the carrying bars 3 become also readily accessible and a replacement can easily be effected by disconnecting hinges 20 and removing the panel and substituting another. Repairs can be made also in the interior between the two sides of the partition since the cavity is fully accessible through the opening created by the swung out panels.

The panel elements 2, 2' are suitably connected to the carrying bars 3 by hinges 20 having hinge parts which are pivotally movable relative to each other and are connected by two links in each hinge. Such hinges are usually called "cup hinges" because their pivotally movable hinge parts are cup-shaped and their two hinge parts together with the interconnected links constitute a four-bar linkage. Such hinges are known in various forms but the preferred hinges 20 are available from Salice America, Inc., as aforementioned. Reference is made to publications showing such hinge connections, e.g., to Published German Applications 31 19 571 and 36 24 237, which disclose such hinges with special designs of the means for fixing the hinge brackets. By such double-link hinges the panel elements 2, 2' can be connected to the carrying bars 3 that when the folding door or wall is closed the panel elements and the carrying bars are disposed in one plane so that the narrow longitudinal sides or end faces of the carrying bars and panel elements are aligned and face each other with only a small clearance. The double-link hinges used in accordance with the invention are so secured to the inside surfaces of the carrying bars 3 and panel elements 2, 2' that when the folding partition is closed, made flat, said carrying bars 3 or panel elements 2, 2' lie in a common plane and owing to the motion characteristic of the four-bar linkage including the double links, the panel elements 2, 2' will be lifted out during an opening movement of the partition and will so be moved relative to outside surfaces of the carrying bars 3 that the narrow longitudinal sidefaces of said panel elements, which narrow longitudinal sidefaces had been aligned with and face the narrow longitudinal sidefaces of the carrying bars 3, now retract behind the narrow longitudinal sidefaces of the carrying bars 3. This means that an opening movement of the partition will cause the panel elements 2, 2' to be folded through almost 90° onto the outside surfaces of the carrying bars 3 so that the folding partition in an open state can be folded together into a compact, space-saving packet or stack.

Desirably, those hinge parts which are provided with hinge brackets are connected to the panel elements 2, 2' and the other hinge parts, which in the usual use of the hinges as furniture hinges are the pivotally movable hinge parts, are connected to the carrying bars 3. In such an assembly the furniture hinges will assume their inherently closed position when the panel elements have been extended so that the partition is in its closed position. As a result, the double-link hinges of the folding door or wall in accordance with the invention are mounted in an unusual manner because the carrying bars 3 which are displaceable but are not pivotally movable, may be regarded as the stationary carrying parts, to which the pivotally movable hinge parts (cups) are secured, whereas the hinge brackets (the hinge arm and mounting plate), which are usually stationary, are secured to the panel elements 2, 2', which are pivotally movable relative to the carrying bars 3.

The other hinge parts desirably consist of cup-shaped hinge parts, which are adapted to be countersunk and are held in milled recesses formed in the narrow end faces of the carrying bars 3 and/or the cleats 15 which interconnect said carrying bars in pairs. The upper and lower cleats 15 together with the bars 3 constitute a frame suspended from track 54 by a trolley attached to the top cleat 15. The frame supports and carries the panels 2, 2' by means of hinges 20.

In a particularly desirable embodiment the hinges or brackets 20 are adapted to be connected by quick disconnectable snap joints to carrying plates 23 which are part of the hinge 20. The plates 23 are secured to the panel elements 2, 2'. Such snap joints between the hinge brackets and carrying plates are known, e.g., from the following publications: Published European Patent Application 348 656; Published European Patent Application 225 609; Published European Patent Application 43 903. It is particularly desirable to connect the hinge brackets to the panel elements 2, 2' by releasable snap joints, which are adapted to be established in that hooking members are hooked in and the hinge arm or bracket is pivotally moved. The panel elements 2, 2' which are held by such so-called clip or cup joints can be quickly disconnected and unhooked at the hinges by a simple actuation and can be similarly hooked in. The preferred hinges 20, as previously noted, use the DOMI® rapid assembly mounting plates with automatic coupling. DOMI® is a trademark of Arturo Salice Sp.A. of Novedrate, Italy.

In accordance with a further desirable feature at least some of the hinges 20 provided on at least one side (preferably panel 2') of a pair of hingedly interconnected panel elements 2, 2' are provided with a spring, which is effective adjacent to the closed position and tends to hold the hinge 20 in its closed position. Such hinges are known, e.g., from German Patent Specification 31 16 825. In response to the closing moment, said hinges 20 will ensure that the panel elements 2, 2' and carrying bars 3 will be aligned in a common plane (lie flat) when the folding partition is closed because the closed position in which the panels and carrying bars lie in one plane corresponds to the closed position in which the hinges are held by spring action. The most preferred form is that the lower hinge 20 on panel 2' be fitted with a spring and the other three hinges 20 (the top one on panel 2' and the two on panel 2) not be fitted with a spring.

In accordance with a further desirable feature of the invention the hinge parts of those hinges which interconnect the panel elements 2, 2' are so countersunk in milled recesses in the narrow longitudinal side faces of said panel elements that the panel elements are aligned and abut in the closed position. Hinges which can be used for such a joint are offered, e.g., by Hafele KG in Nagold, West Germany as Stabilo hinges under the Order No. 341.25.516. The two hinge parts which are held in milled recesses are provided with countersinkable flangelike retaining parts, which are provided with bores for retaining countersunk head screws acting on wedges, which can be loosened, to disconnect the hinges when panels 2, 2' are folded together so that the panel elements 2, 2' can be pivotally moved apart and the other hinges 20 connecting the panel elements 2, 2' to the carrying bars 3 are rendered accessible.

In another embodiment the hinges interconnecting the panel elements consist of so-called curled-up hinges (loose pin hinges 4), which comprise hinge plates that carry curled-up eyes and are screw-connected to the inside surfaces of the panel elements 2, 2'. The hinge pins 12 of said hinges extend through the aligned eyes and are provided with a top head 11 and are held in and adapted to be lifted out of the eyes. Such curled-up hinges are known and are offered, e.g., by Hafele KG in Nagold, West Germany under Order No. 354.13.944. Such hinges afford the advantage that it is not necessary to unscrew a hinge part when the hinges between the panel elements are to be disconnected. It is sufficient to lift upwardly the hinge pin 12, which is held in the eyes with a clearance, in order to disconnect the hinge. The hinge can be re-established just as easily. This is the preferred form.

Desirably, the hinge brackets 20 for hingedly connecting the panel elements 2, 2' to the carrying bars 3 of each side are arranged in vertically spaced apart horizontal planes. That design ensures that the hinge brackets of consecutive carrying bars will not strike against each other in the closed position so that a closer folding in the open position can be achieved.

In accordance with another particularly desirable feature, for which protection is claim per se, the means for pivotally moving the panel elements 2, 2' consist of folding angles or initiating arms 30, one leg of each of said angles is connected to those panel elements 2 of each pair which lead in the direction of the opening movement. End deflectors angled from said legs are disposed adjacent to the carrying bars 3, and the folding angles 30 are so arranged in at least two vertically spaced part, horizontal planes that diagonally opposite ones which are consecutively arranged in a plane and associated with respective sides cooperate without conflict. When the door or wall is being opened said folding angles 30 will cause a folding of each of those outer pairs of panel elements 2 which lead in the direction of the opening movement so that consecutive folding operations will orderly be performed at the end of the opening side.

In such an arrangement only the pairs of panel elements 2' which trail in the direction of the folding movement are desirably connected to the succeeding carrying bars 3 by hinges 20 having a spring-biased snap action so that the leading hinges 20 can be folded more easily without an opposing torque as the buckling moment is introduced into said hinges 20 by means of the folding angles 30.

In accordance with a further particularly desirable feature the track 54 provided on the ceiling is covered on both sides by bars or boards 55 and the spacing of the outside surface of the covering bars 55 corresponds to the spacing of the inside surfaces of the carrying bars 3 and the panel elements 2, 2' in a closed state. Because the special hinges 4, 20 connecting the panel elements 2, 2' to each other and to the carrying bars 3 in the folding partition in accordance with the invention have the result that the panel elements 2, 2' and carrying bars 3 will lie in a plane (flat) in the closed state, the gaps between the bars 55 which cover the track and the inside surfaces of the carrying bars 3 and panel elements 2, 2' may be made so small that they virtually contact each other. Strips of known sealing and sound-proofing material 57 may be secured to the top end portions of the carrying bars 3 and panel elements 2, 2' and will provide an additional sealing action. Said strips of sealing material serve particularly also for sound insulation.

In accordance with a further particularly desirable feature, profiled sealing bars 41 made of elastomeric and/or plastically deformable material are inserted in grooves 40 in the narrow side faces of the panel elements 2, 2' on at least one side or edge. When the folding partition is closed, said sealing bars 41 are disposed between and seal the narrow end faces which face each other and said sealing bars serve particularly for sound insulation.

Because the panel elements 2, 2' can easily be replaced they may be provided with inserts of transparent material or glass because when a panel 2 or 2' has been destroyed or damaged a corresponding panel element can easily and quickly be substituted as a replacement.

For each of the described preferred embodiments and features of the invention, also as far as dependent claims are directed to them, independent protection is claimed. Respective alteration of the claims is reserved.

Another preferred embodiment for which independent protection is claimed provides a one-sided flat foldable partition consisting of carrying bars 3, plate or bar-shaped panel elements 2, 2' which are hinged to carrying bars 3 and are hingedly connected on their narrow longitudinal side faces which face away from the carrying bars 3 and angles 30 for pivotally moving the panel elements as they are pushed together from a closed position in which they lay substantially in a common plane. The hinges 20 between the carrying bars 3 and the panel elements 2, 2' and the hinges 4 between the panel elements 2, 2' consist of furniture hinges mounted in vertically spaced relations without conflict. For this one-sided foldable partition all previously described preferred embodiments and features can be used as far as they relate only to one side of the foldable partition. The one-sided foldable partition preferably can be used as a closure or door for cupboards or the like.

A special feature of the furniture hinges used in the described invention is that they are readily separable. A further feature of the hinges is that they have a relatively small height and are able to be readily disengaged. The hinges may be mounted traditionally, that is, according to usual instructions but also can be mounted reversely as in the case of hinges 20 as described.

Furtheron the panel elements and the carrying bars of each side of the dual walled partition may be arranged in such a way that they in the closed position are not in the same plane.

Furtheron it is desirable that the vertical seals between the bars 3 and panels 2, 2' and between the panels 2, 2' are separate structure from the hinges that the seals only serve as seals and not also hinges.

Seals may serve to reduce sound transmission through flanking paths between track 54 and panels 2, 2'. Seals may be horizontal intermittent seals on the panels and/or carrying bars 3 or may be on the bars 55 or partially on each, the important point being good sealing and sound insulation.

Carrying bars 3 can be in the same plane with panels 2, 2' or behind them to achieve "board and batten" effect. This is readily accomplished by appropriate selection of known hinges 20 to achieve this result. In place of mounting hinges 20 in reverse fashion, the cup hinges 20 can be mounted in the traditional way with the cups in the panels 2, 2'.

Horizontal seals can be under the track or track mould rather than on the back of the panel and/or carrying bars 3.

As an alternative to the panels 2, 2' of the foldable partition being in the same plane as the carrying bars 3, the panels 2, 2' could be arranged to overlay the carrying bars in "half overlay or twin" application. In this alternative, the clearance between the edges of the panels could be made as small as possible for minimal reveal. The clearance also could be increased to create "board and batten" reveal effect. The reveal can be in matching color or contrasting to create a decorative reveal. This arrangement allows seals to be placed on the back of the panels or on the face of the battens rather than on the edges of the panels or battens. The edges of the panels can be shaped or profiled in decorative shape (e.g. rounded).

If in the just described alternative, minimal clearance is used, then the stack depth is minimized and battens or carrying bars 3 as appearance elements are eliminated. The foldable partition can be offered to users with no reveal or with board and batten. There is the choice between matching or contrasting reveals and the edge shapes can be varied.

Glass doors may consist of glass panels connected by cup hinges 20. A number of different models of hinge 20 are available from Salice America, Inc. that are suitable for this purpose.

To make the door or wall almost fireproof, the panels 2, 2' may consist of calcium silicate boards which may have a thickness of approximately 8 mm which would give approximately a two-hour fire rating. With appropriate gasketing material the door could have a two- or three-hour fire rating. Intumescent or mineral fiber material can be used to create a fiber blanket or fire seal as is well known in the art for this purpose and these materials are readily commercially available.

When thin panels (e.g. 8–10 mm) are used, hinges 20 cannot be screwed to the back of the panels 2, 2'. For mounting the hinges 20, routing grooves on the backs of the panels may be provided which may have a dovetail or T-profile, see FIGS. 15A and 15B. The mounting plate or carrying arm of the hinge then may be slipped into the groove and tightened by pressure screws or cupped for friction.

Acoustical performance of the panels may be improved by using various materials, thicknesses, sound-dampening liners and sound absorption liners. Acoustical performance of the flat folding partition can be further improved by increasing thickness of partition (cavity). Thickness of cavity could be varied by having coupling elements (cleats 15) between pairs of carrying bars 3 that would be adjustable in width or modular. The preferred size of cavity is between 3 and 6 inches to obtain the best sound insulating properties consistent with all other requirements.

Acoustical performance can be further improved by resiliently de-coupling the pairs of carrying bars 3. This can be accomplished by e.g. minimizing the number of coupling elements and using elastomeric material in their joining.

The coupling elements (cleats 15) can be made e.g. of molded plastic ready to receive the cup hinges and to slip fit onto the backs of carrying bars 3 by keyholes or the like.

Acoustical performance can be further enhanced by resiliently isolating each panel 2, 2' from its adjacent carrying bar 3 or panel 2, 2' e.g. by gasketing or sealing under cup hinges. Preferably acoustical seals should be made of extruded PVC or closed cell plastic material.

The top track 54 could consist of extruded material to receive the backs of the panels without requiring wood strips 55. Gaskets or seals could be put into the face of the track to avoid segmenting them on the backs of the panels 2, 2'. Optionally, magnetic extruded seals could be used, if the tracks 54 are of a magnetic receptive material, e.g. steel.

Bottom sweep seals may be added and secured to the bottom of panels 2, 2' and bars 3, see FIG. 1. They could be segmented and may be arranged overlaying and adjustable to give full coverage across the bottom of the door. Sweep seals may also be used at the top of the door.

By making the panels wider and thinner very wide openings may be provided with minimum stack depth.

The present invention enables a door with high acoustical and fire performance to be made due to the fact that the joints between the panels 2, 2' are very narrow and can be sealed effectively. Also, the cavity can be made thicker because the door extends flat.

It is possible to eliminate the carrying bars 3 and any spacing between adjacent pairs of panels 2, 2'. The hinges 20 can be fastened together, back-to-back, so that the panel 2 of one pair is directly adjacent the panel 2' of the next leading or preceding pair. The cup portions of the hinges 20 which are connected together, are either connected to cleat 15 or to the pair of hinges 20 on the opposite side. A yoke or frame would be attached to the trolley 50 carrying rollers 51 which in turn is suspended from track 54. The frame could include block or cleats 15 or not. Hinges 20, coupled as noted, would be mounted to the frame and carried thereby. Spacers could be interposed between the hinges 20 and frame to achieve the desired cavity. The frame would have clearance for the angles or arms 30 to permit their action and function as previously described.

Figure 11:
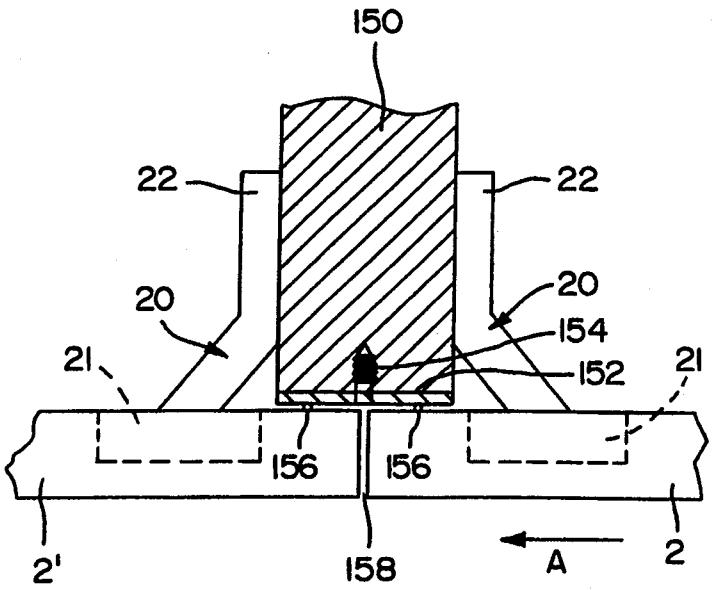
FIG. 11 is a detail of an alternative embodiment.

FIG. 11 shows a detail of an alternative embodiment. Block 150 is the same as cleat 15, that is, rectangular and of limited dimensions. There is an upper block 150 (not shown) and lower block 150 (shown). Blocks 150 are tied together by a full height aluminum extrusion 152 that is anchored on both sides in each block 150 by barbs 154 integral with extrusion 152. Seals 156 are provided on the face of extrusion 152. Blocks 150 extend cross the cavity and are tied together on the other side by an extrusion 152 (not shown) in the same way. Top block 150 has a trolley 50 mounted on it to suspend the frame formed by blocks 150 and extrusions 152 from an overhead track 54. Pairs of panels 2, 2' are carried by block 150 and the next trailing block 150 (not shown) by hinges 20. The opening movement is shown by arrow A.

Panel 2' of a leading pair of panels 2, 2' is mounted to the left side of block 150 by hinge 20 with hinge cup 21 mounted in panel 2' and hinge arm 22 and its associated mounting plate mounted on block 150. A second hinge 20 similarly mounts panel 2 of the next trailing pair of panels 2, 2' to the right side of block 150. The mounting is of the half overlay type with a small reveal 158 between the panels 2' and 2.

Figure 12:
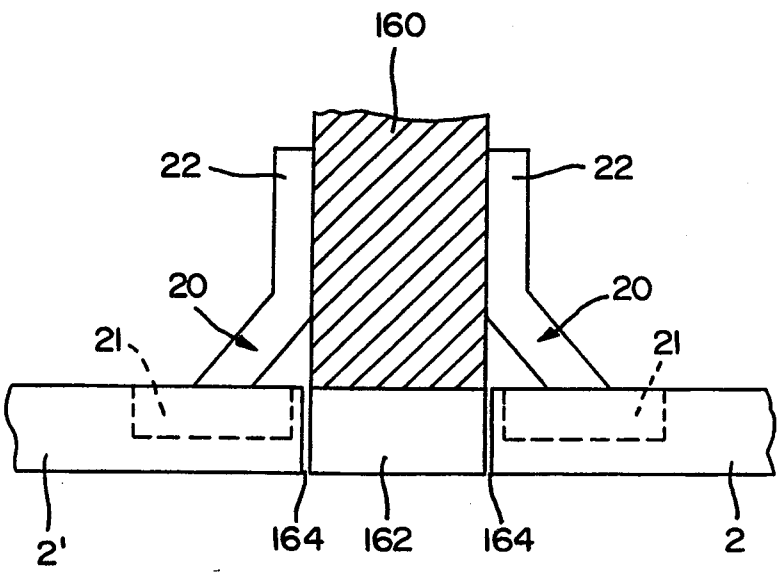
FIG. 12 is a detail of another alternative embodiment.

FIG. 12 shows a detail of another embodiment. A block 160 extends across the partition cavity top and bottom (only one being shown), like cleats 15. Boards or bars 162 extend full height on both sides of blocks 160 and are fastened to blocks 160. Like FIG. 11, hinges 20 mount panels 2' and 2 to block 160. In this embodiment, the partition mounting is flush with small reveals or grooves 164, which can be minimized.

An essential point of the invention resides in the separability of the elements for easy manufacture, assembly, installation, repair, acoustical performance and fire performance.

Figure 13:
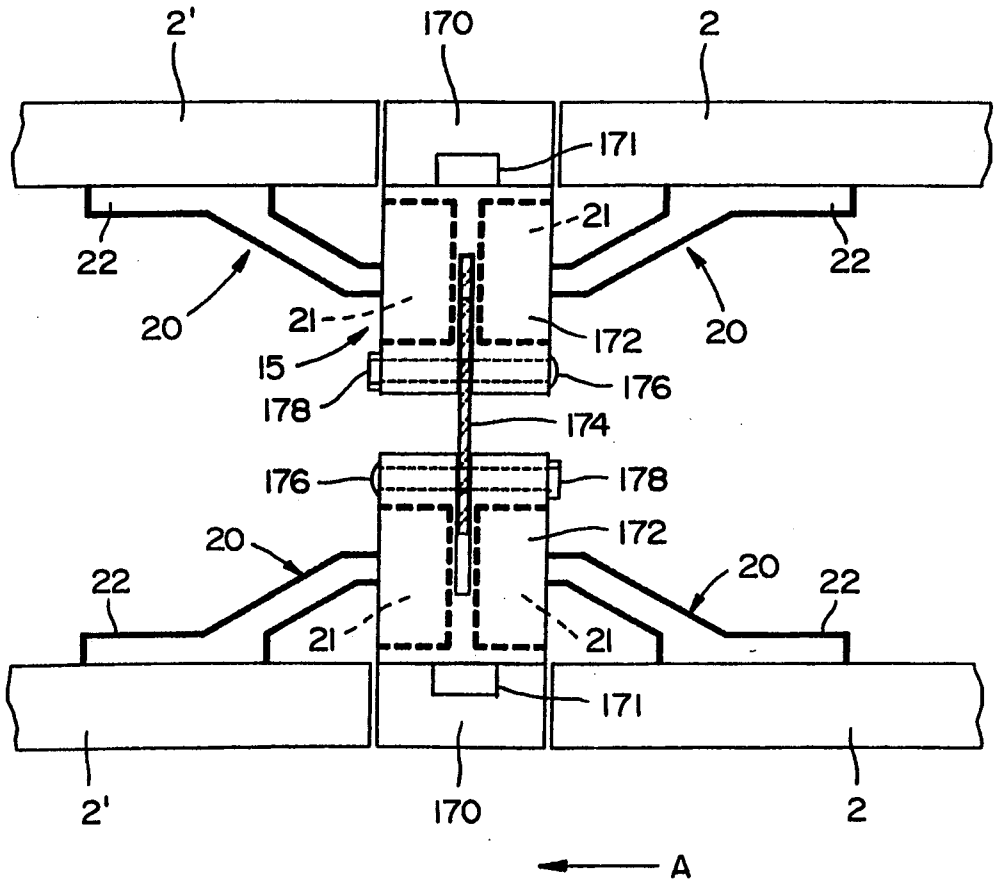
FIG. 13 is a horizontal section through a dual-walled partition showing an expandable cleat or block.

An expandable cleat or block 15 for varying the depth of the cavity in a dual walled partition, according to the present invention, is shown in FIG. 13. The opening direction is shown by arrow A. The arrangement is a flush mounting of panels 2' and 2 and the carrying bars or posts 170. The hinges 20 are mounted as shown in FIG. 1.

The cleat 15 is composed of two blocks 172, each of which is quickly detachably connected in a known load bearing manner as indicated by reference number 171 to one of the bars 170. Cups 21 of hinges 20 are recessed into blocks 172 in known manner. Hinge arms 22 are attached to the inside of panels 2', 2 in known manner.

The blocks 172 are slotted and receive an elongated slotted bar or link 174. Bolts 176, one through a bore in each block 172, extend through the slot in bar 174. The bolts 176 have threaded ends which receive nuts 178. When nuts 178 are loosened, the blocks 172 can be slid apart or together and positioned to create a preselected cavity depth or thickness, whereupon nuts 178 can be tightened.

Figure 14B:
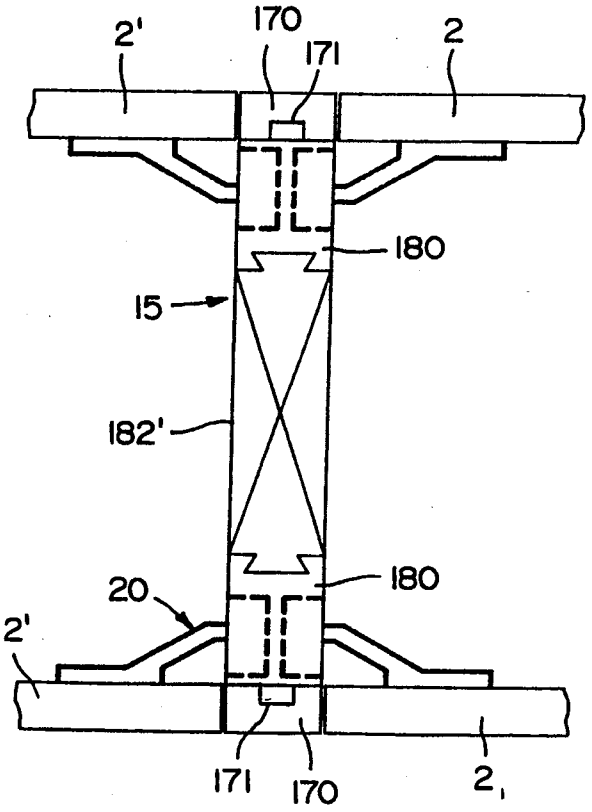
FIGS. 14B are similar views as FIG. 13 showing modular cleats or blocks to achieve a variable cavity depth.
Figure 14A:
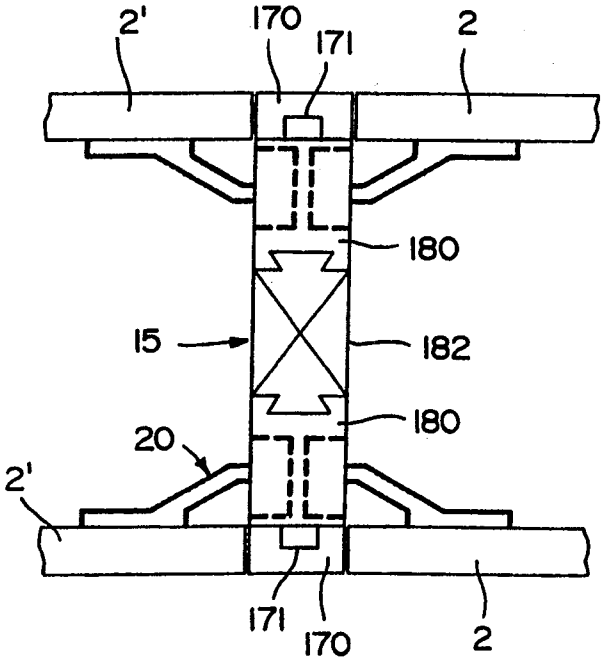

FIGS. 14A and 14B show another technique for obtaining a variable cavity depth or thickness. The arrangement is a flush mounting like FIG. 13. As shown the cleats or blocks 15 are comprised of two sets or fixed blocks or sections 180, each demountably attached to carrying bars 170 in a known load bearing manner 171, such as by mutually cooperating hooks or screws and keyholes. Intermediate the blocks or sections 180 is a modular block 182 demountably attached to sets or fixed blocks 180 by dovetail joints. A plurality or series of: modular blocks 182 of which two are shown as blocks 182, 182' enable the cavity thickness to be varied. Hinges 20 are carried in blocks 180 (permanent in the structure vs the changeable blocks 182).

Figure 15A:
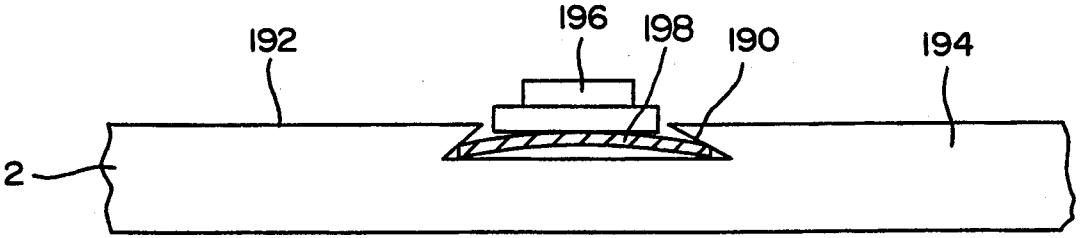
FIGS. 15A and 15B are details showing modifications for mounting hinge parts to panels or carrying posts.
Figure 15B:
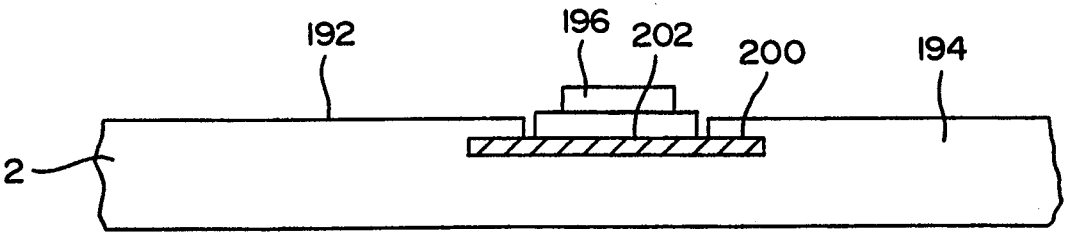

An alternative technique for mounting hinge parts of hinges 20 in panels 2, 2' is shown in FIGS. 15A and 15B. A panel 2 is provided with a dovetail slot or groove 190 (FIG. 15A) or T-slot or groove 200 (FIG. 15B) on its inside face 192, originating from one of its edges 194. A hinge part 196 which could be a hinge cup 21, a hinge arm 22 or a mounting plate 23 is fixed to a curved metal plate 198 that slides into groove 190 and is held under friction or tension. If desired, a stop such as a set screw or pressure plate can be used to lock plate 198 in groove 190.

A flat metal plate, strip or bar 202 slides into groove 200 and has fixed to it the hinge part 196. A lock or stop cooperates with plate 202 to retain it in groove 200. Plate 202 can also be adhesively fixed in groove 200.

Figure 16:
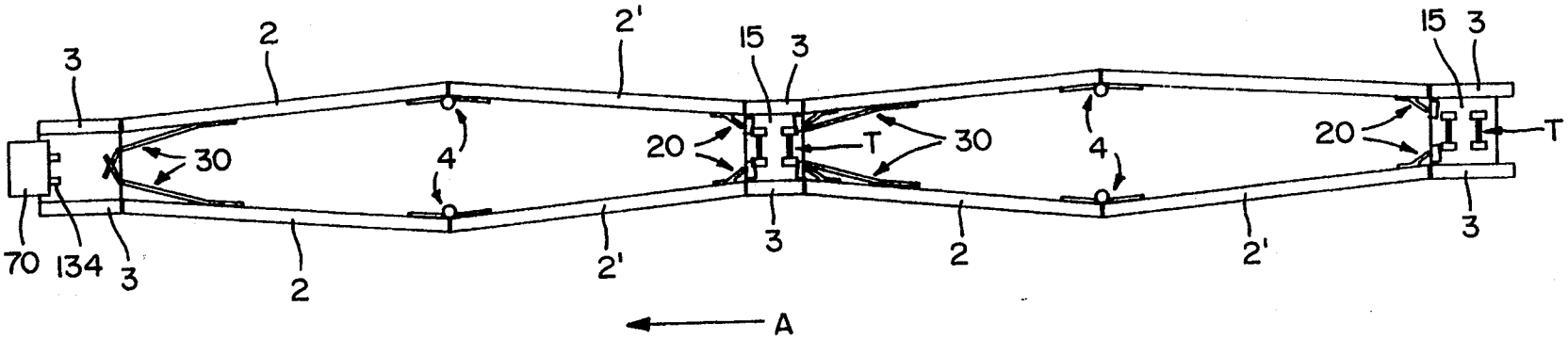
FIG. 16 shows in top plan an alternative embodiment wherein panels lie at shallow angles when in the closed position.
Figure 16A:
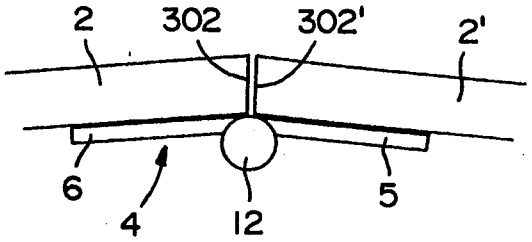
FIGS. 16A and 16B Show details of FIG. 16.

FIG. 16 shows an embodiment where the panels 2, 2' are maintained at shallow angles, preferably 5°–30°, when in the closed position, as shown in the drawing. The abutting edges 302, 302' of panels 2, 2' are beveled at angles such that in the closed position, they will approximate to the least gap or butt, as shown in FIG. 16A. The trolleys are shown schematically as T and are mounted on top cleats 15. The terminal carrying posts 3 are shown at the left side of the figure and telescopically extend on either side of fixed jamb post 70 carrying the initiating abutments 134. For convenience not all cup hinges 20 are shown. Folding angles or arms 30 may be possibly omitted in this form of the invention because the shallow angles allow the panels to fold when the partition is pushed in the opening direction as indicated by arrow A.

Figure 16B:
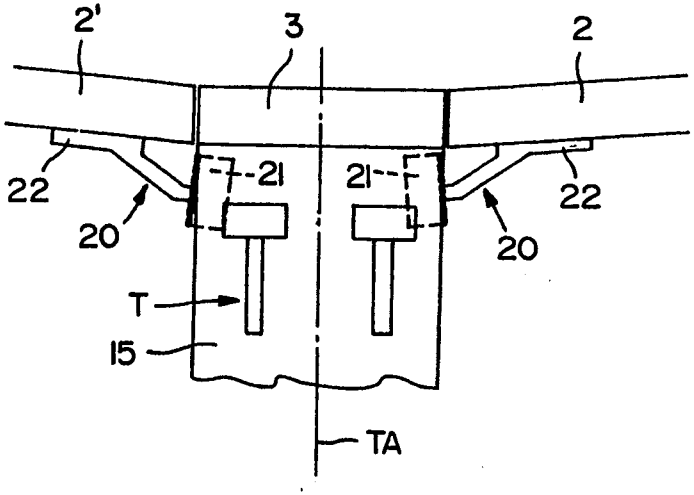

As shown in FIG. 16B, the cup hinges 20 are mounted with cups 21 angulated with respect to the transverse axis or plane of the partition through cleat 15. As shown, the cups 21 lie at a shallow angle, preferably from about 5° to about 30° relative to the transverse axis TA of the partition through the cleat 15. The cups 21 are turned outwardly to establish the shallow angle of panels.2, 2'.

Acoustic isolation of the two sides of a dual-walled partition according to the present invention can be achieved by interposing resilient or non-resilient sound damping material in any of the joints, e.g., between carrying posts 3 and cleats 15 or within the cleat 15 structure as shown in FIGS. 13, 14A and 14B. In FIG. 13, resilient material can surround and encase the slotted bar 174 to isolate it from blocks 172 and resilient material can surround bolts 176 to isolate them from blocks 172 and bar 174. Similarly, in FIGS. 14A and 14B, the joints between fixed or set blocks 180 (fixed or set dimensionally) and modular block 182 can include resilient material that sound isolates. Gasketing in this fashion will isolate one side of a dual-walled partition from the other. Controlling cavity depth or thickness will enable excellent sound absorbing or attenuation to be attained.

As previously noted, cleats 15 and carrying posts 3 are connected together to constitute a frame from which panels 2, 2' are carried by hinges 20. In FIG. 13, the connection between posts 170 and blocks 172 is shown schematically by reference number 171. The top cleat 15, which is attached to the trolley T that hangs from track 54, suspends or carries the posts 170. In turn, the posts 170 carry the lower blocks 172. Therefore, the demountable coupling, if one is used in place of a fixed coupling, must be arranged to accommodate or satisfy the above requirements.

In addition to the above, sound isolation or proofing can be improved by using top and/or bottom sweep strips that coact with the horizontal surfaces that define the upper and lower limits of the opening in which the folding partition is mounted. Shown schematically in FIG. 1 are sweep strips 400, 401 which are segments attached respectively to the top and bottom edges of panels 2, 2' and carrying posts 3. Segments 401 overlap segments 400 at joints to secure isolation at these points. The sweeps on the bottom are more important because the tops of the panels and carrying posts already have seals cooperating with the board 55. The seals 400 are attached to the back lower edges of the panels and carrying posts.

Although the invention has been described in terms of specific and preferred embodiments, nevertheless, changes and modifications will be apparent to those skilled in the art which do not depart from the spirit, scope and contemplation of the inventive concepts taught herein. Such are deemed to fall within the purview of the appended claims.

I claim:

1. A folding partition comprised of a plurality of vertical carrying posts, roller means mounted on the carrying posts for supporting the carrying posts from a horizontal track, a plurality of vertical panels arranged in pairs, each panel having two vertical edges, panel supporting hinges pivotally connecting one vertical edge of each panel of a pair of panels to a carrying post, panel connecting hinges pivotally connecting the other vertical edges of said pair of panels together, and means for initiating pivotal movement of the panels as they are moved from a closed position in which they lie substantially in edge to edge relationship, said panel supporting hinges being cup hinges having hinge parts including a hinge cup and hinge arm which are connected by link means and are pivotally moveable relative to each other, one of said hinge parts being mounted in said panels for pivotal movement, the other of said hinge parts being mounted in said carrying posts for non-pivotal movement, said hinge cup being pivotally linked to said hinge arm by said link means.

2. A folding partition as defined in claim 1, wherein said partition is a single-walled partition.

3. A folding partition as defined in claim 1, wherein said partition is a dual-walled partition.

4. A folding partition as defined in claim 1, wherein said panels when in closed position lie substantially in a common plane.

5. A folding partition as defined in claim 4, wherein the upper end portions of the inside surfaces of said panels engage the sides of said track or the sides of a track facing element when said panels are in their closed position.

6. A folding partition as defined in claim 5, wherein horizontal top seals are secured to the upper end portions of the inside surfaces of said panels for sealing engagement with said track or with said track facing element.

7. A folding partition as defined in claim 1, wherein said panels when in closed position lie at a shallow angle to each other.

8. A folding partition as defined in claim 1, wherein said track is disposed above said partition.

9. A folding partition as defined in claim 1, wherein said track is spaced vertically from said partition.

10. A folding partition as defined in claim 1, wherein said panel supporting hinges have a relatively small height in relation to the height of said partition and allow said panel to be readily disconnected from said carrying post.

11. A folding partition as defined in claim 1 wherein said cup hinges have their said hinge cups mounted in said carrying posts for non-pivotal movement and have their said hinge arms mounted on said panels for pivotal movement.

12. A folding partition as defined in claim 11, wherein said cup hinges include mounting plates secured to said panels and said hinge arms are connected by disconnectable snap joints to said mounting plates.

13. A folding partition as defined in claim 1, wherein said panels are relatively thin and mounting means are provided for connecting said panel supporting hinges and/or said panel connecting hinges to the backs of said panels without penetrating into said panels by screws.

14. A folding partition as defined in claim 13, wherein said mounting means is comprised of shallow dovetail or T-profiled grooves routed into the backs of said panels and specially adapted mounting plates received in said grooves.

15. A folding partition as defined in claim 1, wherein each panel supporting hinge connected to one panel of a pair of panels is positioned at a different elevation from the corresponding panel supporting hinge connected to the other panel of said pair of panels in order to avoid interference between said panel supporting hinges when said pair of panels are pivoted to their open position.

16. A folding partition as defined in claim 1, wherein at least one of said panel supporting hinges associated with each of said pair of panels is provided with a spring which is effective adjacent to the closed position and tends to hold said panel supporting hinge in its closed position and said pair of panels in their closed position.

17. A folding partition as defined in claim 1, wherein said panel connecting hinges have a relatively small height in relation to the height of said partition and allow said panels to be readily disconnected from each other.

18. A folding partition as defined in claim 17, wherein said panel connecting hinges are concealed mortise hinges mounted into milled recesses on the vertical side edges of said panels.

19. A folding partition as defined in claim 17, wherein said panel connecting hinges are loose pin hinges comprised of hinge plates having intermeshing curled-up eyes, said hinge plates being mounted on the inside surfaces of said panels, and easily removable hinge pins which extend through the aligned eyes with clearance to hold said hinge plates together for relative pivotal movement.

20. A folding partition as defined in claim 1, wherein each of said carrying posts is comprised of two vertical carrying post face elements having substantially the same height as the height of said partition and a plurality of carrying post joining elements which are of relatively small height and which connect the two carrying post face elements to each other, said carrying post joining elements being adapted to receive said panel supporting hinges and in the case of the topmost joining element on each carrying post, adapted to receive said roller means.

21. A folding partition as defined in claim 20, wherein said carrying post joining elements are made of molded plastic provided with means for readily attaching said panel supporting hinges and said carrying post face elements.

22. A folding partition as defined in claim 20, wherein said partition is dual-walled and said carrying post joining elements are adapted to be adjustable in width or modular in order to vary the thickness of the partition cavity.

23. A folding partition as defined in claim 20, wherein said partition is dual-walled and said carrying post joining elements are adapted to resiliently de-couple the two walls of the partition from each other.

24. A folding partition as defined in claim 20, wherein when said partition is in its closed position the faces of the panels and the faces of the carrying post face elements are in the same plane thereby giving the closed partition a substantially flat wall appearance.

25. A folding partition as defined in claim 20, wherein when the partition is in its closed position panels overly the carrying post face element in adjacent vertical planes.

26. A flat folding partition as defined in claim 25, wherein panels overly the carrying post face element in "half overly or twin" application so that the clearance between the vertical edges of the panels which overlay the carrying post face element is made minimal.

27. A folding partition as defined in claim 25, wherein the clearance between the vertical edges of the panels which overlay the carrying post face element is increased to create a "board and batten" reveal effect.

28. A folding partition as defined in claim 1, wherein the vertical gap between each panel and the carrying post to which it is connected is sealed by a vertical carrying post seal when the panels are in closed position, said vertical carrying post seal having a height substantially the same as the height of said partition and being so arranged that it seals but does not connect said panel and said carrying post to each other, the connection being accomplished only by said panel supporting hinges.

29. A folding partition as defined in claim 28, wherein said vertical carrying post seal is mounted on an inner edge portion of said panel for sealing against said carrying post.

30. A folding partition as defined in claim 28, wherein said vertical carrying post seal is mounted on said carrying post for sealing against an inner edge portion of said panel.

31. A folding partition as defined in claim 1, wherein the vertical gap between the panels in each pair of panels is sealed by a vertical panel seal when the panels are in closed position, said vertical panel seal having a height substantially the same as the height of said partition and being so arranged that it seals but does not connect said panels to each other, the connection being accomplished only by said panel connecting hinges.

32. A folding partition as defined in claim 31, wherein said vertical panel seal is mounted in a vertical groove on the vertical edge of at least one of the panels of said pair of panels.

33. A folding partition as defined in claim 31, wherein said vertical panel seal is comprised of a strip of flexible material having one edge portion mounted on the inside surface of one of the panels of said pair of panels to cover said gap and retaining means mounted on the inside surface of the other panel of the pair for slidably retaining the other edge portion of said strip.

34. A folding partition as defined in claim 1, wherein horizontal top seals are secured to the upper ends of the panels and carrying bars for sealing engagement with a header or ceiling.

35. A folding partition as defined in claim 1, wherein horizontal bottom seals are secured to the lower ends of the panels and carrying bars for sealing engagement with a floor.

36. A folding partition as defined in claim 1 having horizontal top and/or bottom seals that are segmented and may be arranged overlapping and/or adjustable.

37. A folding partition as defined in claim 1, wherein said panels are composed of fire resistive material such as rigid mineral fiber board, calcium silicate board or steel, and have vertical and horizontal seals composed of fire resistive material such as mineral fiber or intumescing material.

38. A folding partition as defined in claim 1, wherein each of said pairs of panels of said partition consists of a lead panel which leads in the opening direction and a trail panel which trails in the opening direction and said means for initiating pivotal movement of said panels is comprised of at least one actuator arm connected to the back of each lead panel of said partition, each actuator arm including an actuating portion disposed in the zone of the carrying post to which said lead panel is connected.

39. A folding partition as defined in claim 38 wherein said partition is single-walled and during opening movement of said partition the actuator arm of a preceedingly opened pair of panels actuatingly engages the actuator arm of the next succeeding pair of panels thereby initiating pivotal opening movement of said succeeding pair of panels.

40. A folding partition as defined in claim 38, wherein said partition is dual-walled and during opening movement of said partition the actuator arm of a preceedingly opened pair of panels in one wall of said partition actuatingly engages the actuator arm of the next succeeding pair of panels in the other wall of said partition thereby initiating pivotal opening movement of said succeeding pair of panels.

41. A folding partition as defined in claim 40, wherein the actuator arms of said partition lie in at least two vertically spaced apart, horizontal planes to avoid interference.

42. A folding partition as defined in claim 40, wherein said actuator arm includes a connecting portion parallel to and connected to said lead panel, said actuating portion lies at an angle of about 90° to said connecting portion, and an intermediate portion that lies at an angle of about 30° to said connecting portion, said intermediate portion interconnecting said connecting and actuating portions.

43. A folding partition as defined in claim 38, wherein the first carrying post of said partition counting from the opening direction is a horizontally telescoping carrying post which telescopically retracts upon initial opening movement of said partition and which includes at least one starter abutment that actuatingly engages the actuator arm of the succeeding pair of panels, which is the first pair of panels counting from the opening direction, thereby initiating pivotal opening movement of said first pair of panels.

44. A folding partition as defined in claim 1 wherein said cup hinges have their said hinge arms mounted on said carrying posts for nonpivotal movement and have their hinge cups mounted in said panels for pivotal movement.

45. A folding partition as defined in claim 44, wherein said cup hinges include mounting plates secured to said carrying posts and said hinge arms are connected by disconnectable snap joints to said mounting plates.

46. A folding partition as defined in claim 1 wherein at least one of said cup hinges associated with each of said pair of panels is provided with a spring which is effective adjacent to the closed position and tends to hold said cup hinge in its closed position and said pair of panels in their closed position.

47. A folding partition as defined in claim 46, wherein said cup hinge that is provided with a spring is associated with the trailing panel of said pair of panels in the direction of opening.

48. A folding partition as defined in claim 47, wherein said cup hinge that is provided with a spring is the bottommost of the cup hinges associated with said trailing panel.

* * * * *